US007051628B2

(12) United States Patent
Wilson

(10) Patent No.: US 7,051,628 B2
(45) Date of Patent: May 30, 2006

(54) IMPACT WRENCH

(75) Inventor: Mark Stephen Wilson, Fig Tree Pocket (AU)

(73) Assignee: Private Brand Tools (Australia) Pty Ltd, Darra (AU)

( * ) Notice: Subject to any disclaimer, the term of this patent is extended or adjusted under 35 U.S.C. 154(b) by 173 days.

(21) Appl. No.: 10/735,870

(22) Filed: Dec. 16, 2003

(65) Prior Publication Data

US 2005/0126350 A1 Jun. 16, 2005

(51) Int. Cl.
*B25B 19/00* (2006.01)

(52) U.S. Cl. ..... 81/463; 173/93.7; 81/177.7

(58) Field of Classification Search ..... 81/463, 81/177.7, 465, 466, 177.8, 177.85; 173/93.7, 173/121, 205, 93
See application file for complete search history.

(56) References Cited

U.S. PATENT DOCUMENTS

| | | | | |
|---|---|---|---|---|
| 1,361,130 | A * | 12/1920 | York | 81/177.75 |
| 1,473,436 | A * | 11/1923 | Leopold | 81/58.3 |
| 2,543,441 | A * | 2/1951 | Crummey | 81/463 |
| 2,559,558 | A | 7/1951 | Carlson et al. | |
| 2,638,807 | A | 5/1953 | Sharman | |
| 2,951,405 | A * | 9/1960 | Engquist | 81/177.8 |
| 4,334,445 | A * | 6/1982 | Timewell | 81/177.7 |
| 4,745,980 | A * | 5/1988 | Chung | 173/93.7 |
| 5,012,709 | A * | 5/1991 | Su | 81/466 |
| 6,176,161 | B1 * | 1/2001 | Huang et al. | 81/441 |
| 6,814,159 | B1 * | 11/2004 | Huang | 173/205 |

FOREIGN PATENT DOCUMENTS

| | | |
|---|---|---|
| FR | 2 762 537 | 10/1998 |
| GB | 682567 | 11/1952 |
| GB | 710707 | 6/1954 |

OTHER PUBLICATIONS

Snap on Tools product Catalogue, Jan. 1995, p. 95.

* cited by examiner

*Primary Examiner*—Hadi Shakeri
(74) *Attorney, Agent, or Firm*—Nixon & Vanderhye P.C.

(57) ABSTRACT

An impact wrench is disclosed. The wrench has a handle and a housing pivotally secured to one end of the handle. A socket drive cooperates with the housing and the socket drive receives a socket for engagement with a fastener. A follower is associated with the housing and holds the socket drive in either a first or a second position allowing the wrench to rotate the fastener in either direction and the socket drive being biased to maintain the follower in one of its positions. The socket drive has first and second camming surfaces and when the housing is struck by an impact implement, the following moves relative to one of the surfaces and the socket drive is caused to rotate relative to the housing.

13 Claims, 4 Drawing Sheets

IMPACT WRENCH

BACKGROUND OF THE INVENTION

This invention relates to an impact wrench.

Fasteners sometimes become stuck or frozen and are difficult to loosen with a wrench. An impact tool is known and the tool has a longitudinal housing which may be grasped by a user. The housing carries a socket drive relative to which a socket may be secured for engagement with the head of a fastener.

An end of the housing may be struck by an impact implement to cause the socket drive to rotate in a loosening direction to assist in moving the fastener in a loosening direction. Once the impact tool was used to loosen a frozen fastener, the tool was removed from the fastener and a wrench was then used to completely loosen and undo the fastener to allow for its removal.

Thus, two separate tools (the impact tool and the wrench) were required to unfreeze, loosen and remove the fastener. This was undesirable.

OBJECT OF THE INVENTION

It is an object of the invention to provide an impact wrench which at least minimises the disadvantage referred to above.

SUMMARY OF THE INVENTION

According to an aspect of the invention there is provided an impact wrench having a handle, a housing pivotally secured to the handle, a socket drive cooperative with the housing, the socket drive being adapted to receive a socket for engagement with a fastener, a follower associated with the housing holding the socket drive in either a first position allowing the wrench to rotate the fastener in a loosening direction or a second position allowing the wrench to rotate the fastener in a tightening direction, the socket drive being biased to maintain the follower in either the first or the second position relative to the socket drive and the socket drive having first and second camming surfaces, whereby, when the housing is struck by an impact implement the follower is caused to move relative to one of the camming surfaces whereby the socket drive is caused to rotate relative to the housing.

It is preferred that the follower be a pin about which the housing is pivotally secured to the handle.

The handle may have a yoke at one end thereof and a portion at the opposite end thereof which may be grasped by a user. The portion may be patterned or otherwise finished to provide for a slip free portion which may be grasped by the user. Preferably the portion of the handle grasped by the user is knurled.

The yoke may have two spaced arms between which the housing is received. The pin extends between the two arms.

The housing may be pivoted from a position where its longitudinal axis extends in line with the longitudinal axis of the handle. When the longitudinal axes are in line, the wrench may be used as a speed brace.

The housing has a free end that may be struck by the impact implement. Preferably the free end has a curved portion which merges with the side of the housing. Preferably the housing is cylindrical in shape and the free end is round.

A spring may bias the socket drive to bias the follower into either of its two positions. The spring is preferably located within the housing and extends between the housing and the socket drive.

The socket drive has an end for receiving a socket. The end may consist of a square shaft with at least one of the facets of the square shaft having a spring biased detent ball for engagement with the socket.

Preferably the socket drive has a blind bore extending into it from one end relative to which the biasing spring may be received. A wall of the socket in the region of the bore preferably has apertures through which the pin extends to hold the socket drive relative to the housing. These apertures may provide the camming surfaces previously mentioned. The camming surfaces are part helical.

Preferably, two apertures are present and the apertures are diametrically opposed to one another. The apertures are preferably heart shaped having a left hand and a right hand lobe with curved lower region spaced from the lobes. The camming surfaces extend from the lower region to each of the lobes.

The end of the socket drive which receives the spring may have a shoulder against which the spring may bear to bias the socket drive as previously mentioned.

DETAILED DESCRIPTION OF THE PREFERRED EMBODIMENT

Figure 1:
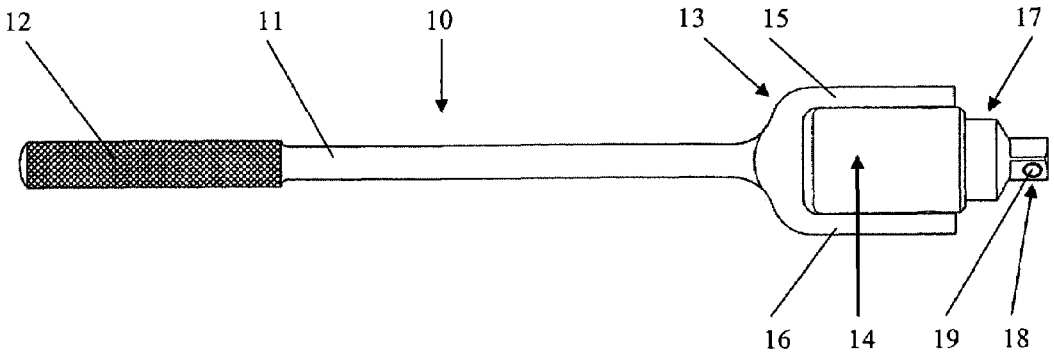
FIG. 1 is a plan view of an impact wrench according to a preferred embodiment of the invention.

The impact wrench 10 of the invention has a handle 11 with a knurled end 12 which may be grasped by a user. A yoke 13 is present at the end of the handle 11 opposite knurled end 12. The yoke 13 receives a housing 14 between arms 15, 16 of the yoke 13. The housing 14 receives a socket drive 17. Drive 17 has an end 18 for receiving a socket (not shown). The drive 17 has a spring biased detent ball 19 which assists in releasably coupling the socket to the socket drive 17.

Figure 2:
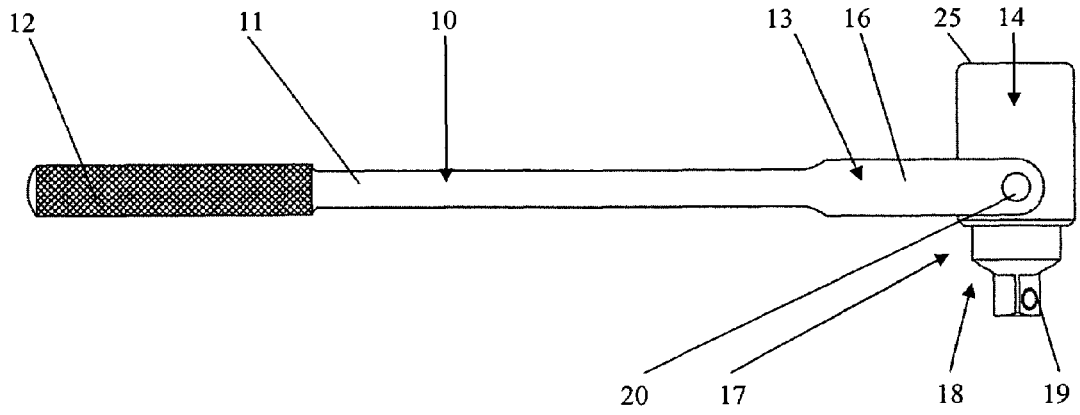
FIG. 2 is an elevational view of the wrench of FIG. 1 shown with its housing rotated through 90° with respect to the position shown in FIG. 1.

The housing 14 is rotatably received between arms 15, 16 of the yoke 13 by a pin 20 (see FIG. 2). When the wrench is in the configuration shown in FIG. 1, the longitudinal axis through the housing 14 coincides with the longitudinal axis through the handle 11. In this configuration and with a socket mounted relative to the drive 17, the wrench may be used as a speed brace. By rotating the wrench about the longitudinal axis through the handle a loosened fastener engaged by the socket may be rotated relatively freely in either a loosening or tightening direction.

FIG. 2 shows the configuration that the wrench 10 must be placed into to allow it to be used as a wrench to either tighten or loosen a fastener. This configuration is achieved by commencing with the configuration shown in FIG. 1 and rotating the housing 14 through 90 degrees about the pin 20. It is not essential that the longitudinal axis of the housing be at right angles to the longitudinal axis of the handle.

The housing 14 receives the socket drive 17 and the pin 20 prevents the drive 17 from separating from the housing 14. The housing 14 has an end 25 spaced from the drive 17. End 25 may be struck by an impact implement such as a hammer 26 (see FIG. 6).

Figure 3:
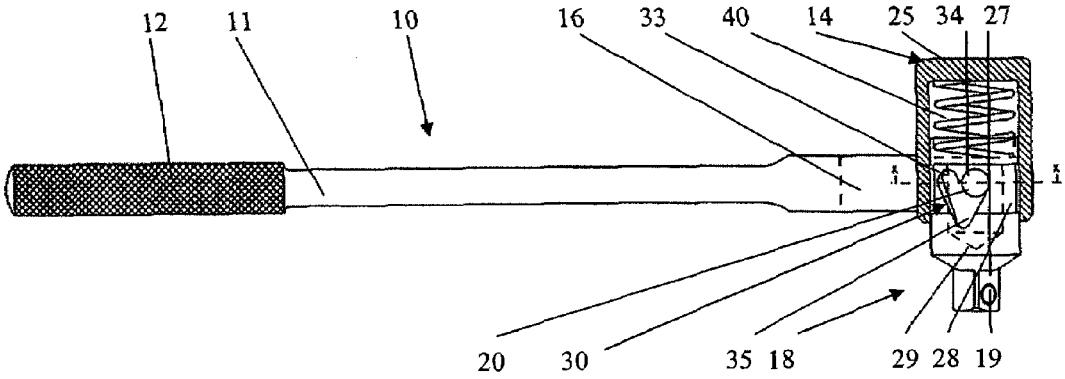
FIG. 3 is a part sectioned elevational view of the wrench of FIG. 2.

FIG. 3 shows a view of the wrench 10 with the housing 14 sectioned to reveal details of the socket drive 17 and other components.

The socket drive 17 has a square shaft 27 for engagement with a socket. One of the facets of the square shaft receives the spring biased detent ball 19 previously mentioned. The drive 17 has a bore 28 extending into it and the bore 28 terminates in a blind countersunk inner end 29. The wall 30 of the drive 17 has diametrically opposed heart shaped apertures 31, 32 formed in it. Each of these apertures has upper left and right lobe regions 33, 34 and a curved lower region 35. The left hand surface of the aperture extending from lobe region 33 to lower region 35 is of a part helical configuration.

Likewise, the right hand surface of the aperture extending from lobe region 34 to the lower region 35 is also of a part helical configuration. The heart shaped apertures are mirror symmetrical about a central vertical plane.

The socket drive 17 has an open end distant from square shaft 27 with a stepped region 36 for receiving a spring 40. The spring 40 bears against an inner face of end 25 and biases the socket drive 17 outwardly of the housing 14. The pin 20 extends through the apertures 31 and 32.

The pin 20 may be received within either the left or right lobe region 33, 34. When the pin 20 is in the left lobe region 34 of each aperture 31, 32, the wrench may be used to tighten a fastener or to rotate the fastener in a tightening direction. The pin 20 engages against lobe region 33 of each aperture and the upper end of surface 37 of each aperture. When the pin 20 is engaged in lobe region 34 and with the upper end of surface 38 as shown in FIG. 3, the wrench may be used to rotate a fastener in the loosening direction.

The pin 20 may readily be caused to move from one lobe region to the other by preloading the handle 11 to cause the housing 14 to rotate about its longitudinal axis relative to the socket drive 18. This is possible regardless of whether the wrench is in the FIG. 1 or FIG. 2 configuration.

Figure 6:
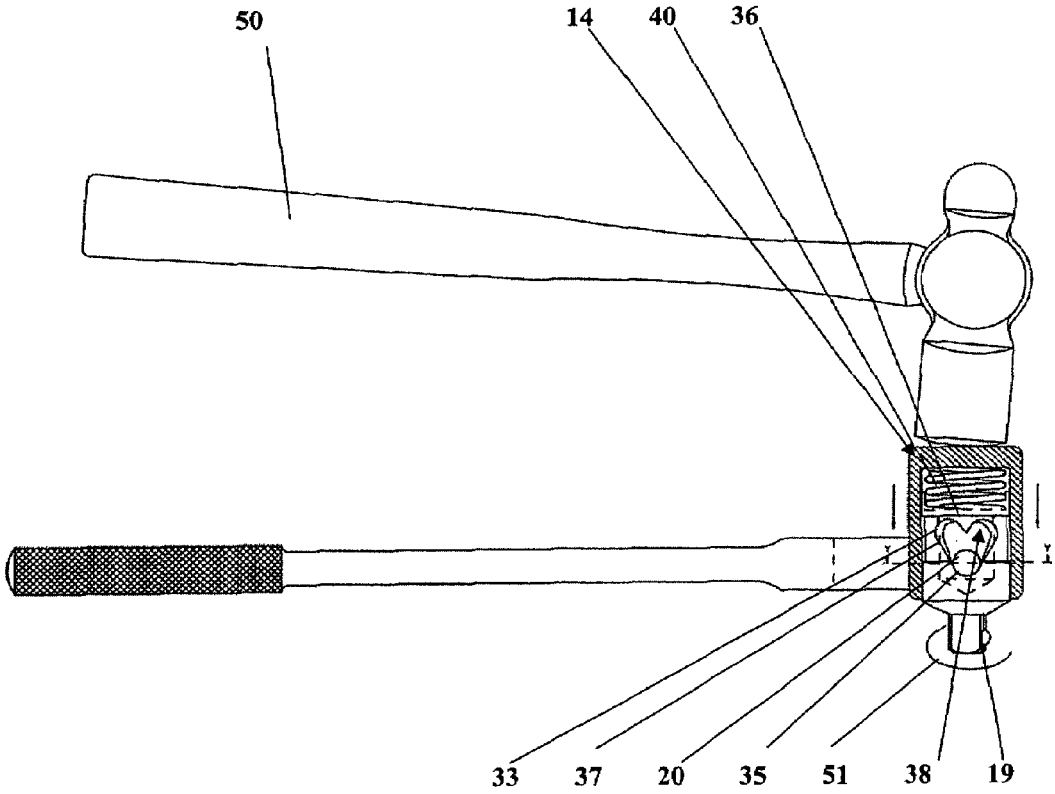
FIG. 6 is a part sectioned elevational view of the wrench of FIG. 2 shown in the configuration which results when the housing is struck with an impact implement.
Figure 5:
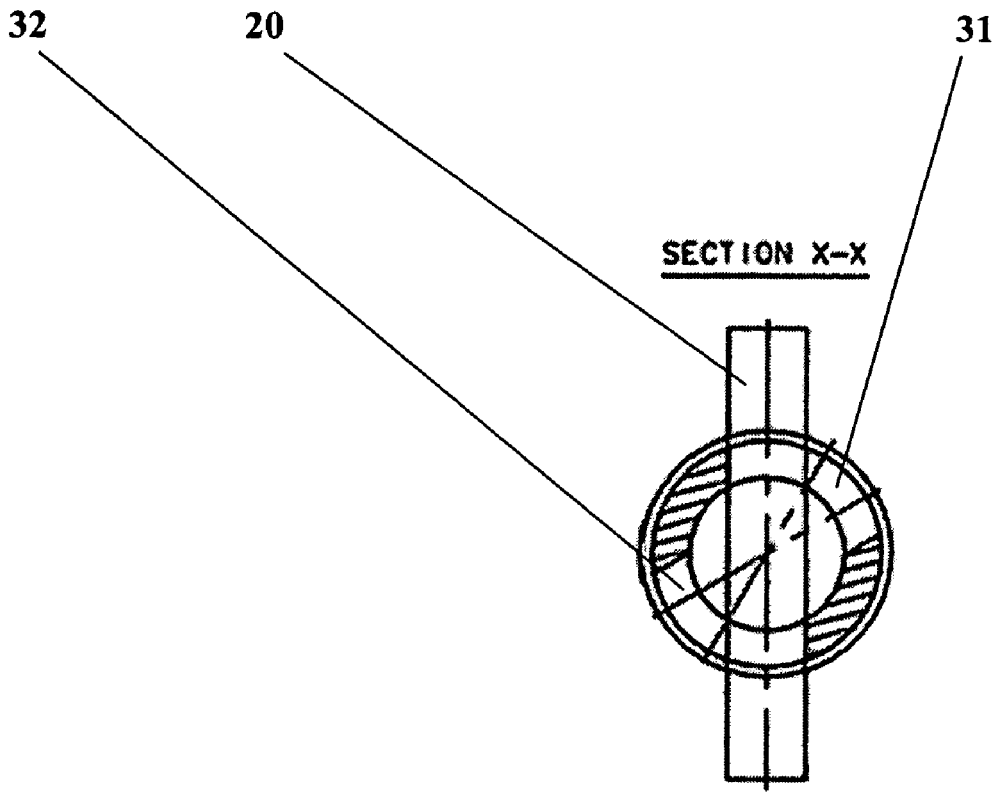
FIG. 5 is a sectional view of the housing taken along line x—x in FIG. 3.
Figure 4:
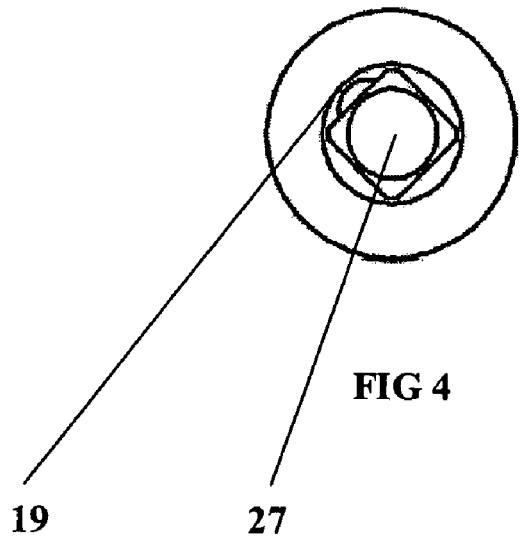
FIG. 4 is an end view of a portion of the wrench shown in FIG. 3.
Figure 8:
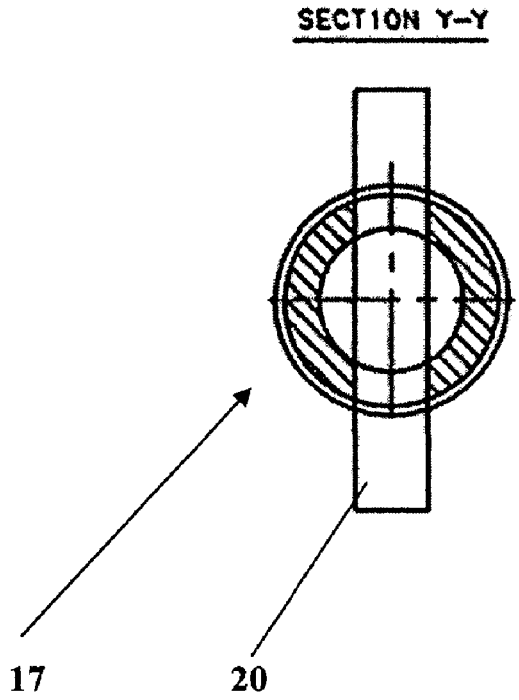
FIG. 8 is a sectional view of the housing taken along line y—y of FIG. 6.
Figure 7:
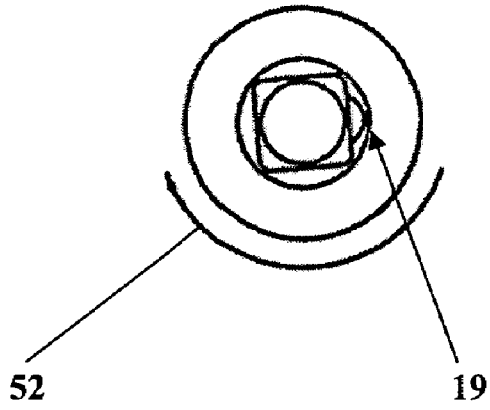
FIG. 7 is an end view of a portion of the wrench shown in FIG. 6.

FIG. 6 shows the housing 14 of the wrench being struck by a hammer 50. When the wrench is in the configuration shown in FIG. 3 with the pin 20 in the right hand lobe regions 34 of both of the apertures 31, 32 and the housing 14 is struck by a hammer 50, the spring 40 is compressed momentarily. In addition pin 20 is caused to move along surface 38 of each of the apertures 31, 32. Because the surface 38 is part helical, the surface is maintained in line contact with the pin and the socket drive 17 is caused to rotate in the loosening direction of a fastener engaged by the socket carried by square shaft 27. This rotation is in the direction of arrow 51 in FIG. 6 or arrow 52 in FIG. 7. The pitch of the part helical surfaces 37, 38 has a relationship to the degree of rotation imparted on the socket drive 18 when the housing is impacted and on the magnitude of the force required to cause the rotation.

The user should securely hold the handle 11 whilst striking the housing 14 to counter balance movement of the handle during the rotation of the drive 17 caused by the striking action. The rotation of the socket drive achieved by the impact force applied to the housing is useful in loosening fasteners that are stuck or difficult to undo.

It is also possible with the pin 20 in the left hand lobe portions of the apertures 31, 32 to apply an impact force to the housing to cause the socket drive to rotate in the tightening direction to securely tighten fasteners.

I claim:

1. An impact wrench having a handle, a housing pivotally secured to the handle by a follower, the follower providing for pivotal movement of the housing relative to the handle along a single pivot axis only and the follower being located between ends of the housing, a socket drive cooperative with the housing, the socket drive being adapted to receive a socket for engagement with a fastener, said follower associated with the housing holding the socket drive in either a first position allowing the wrench to rotate the fastener in a loosening direction or a second position allowing the wrench to rotate the fastener in a tightening direction, the socket drive being biased to maintain the follower in either the first or the second position relative to the socket drive and the socket drive having first and second camming surfaces, whereby, when the housing is struck by an impact implement, the follower is caused to move relative to one of the camming surfaces whereby the socket drive is caused to rotate relative to the housing.

2. The impact wrench of claim 1 wherein the end of the handle has a yoke and the housing is received by the yoke.

3. The impact wrench of claim 2 wherein the yoke has spaced arms and the housing is pivotally received by and between the arms.

4. The impact wrench of claim 1 wherein the follower is a pin and the pin pivotally connects the housing to the handle.

5. The impact wrench of claim 4 wherein the socket drive has a blind bore forming a hollow region in the socket drive and the camming surfaces are provided in apertures extending through the hollow region.

6. The impact wrench of claim 5 wherein the camming surfaces are part helical.

7. The impact wrench of claim 5 wherein the apertures are diametrically opposed to one another.

8. The impact wrench of claim 5 wherein the apertures are heart shaped having a left hand and a right hand lobe with a spaced rounded region whereby the camming surfaces are provided by a surface extending between the left hand lobe and the spaced rounded region and by a surface between the right hand lobe and the spaced rounded region.

9. The impact wrench of claim 8 wherein the camming surfaces are part helical.

10. The impact wrench of claim 8 wherein the apertures have mirror symmetry about an axis extending from the spaced rounded region to a location between the lobes.

11. The impact wrench of claim 5 wherein the bore in the socket drive has a shoulder against which a spring which provides the bias to the socket drive may locate.

12. The impact wrench of claim 1 wherein the socket drive has an end in the form of a shaft with a square transverse cross section for receiving the socket.

13. The impact wrench of claim 12 wherein the shaft has a spring biased detent ball for engaging the socket for holding the socket relative to the shaft.

* * * * *